US012071270B2

(12) United States Patent
Girimonte

(10) Patent No.: US 12,071,270 B2
(45) Date of Patent: Aug. 27, 2024

(54) SAUSAGE TRAY AND PACKAGING METHOD

(71) Applicant: MEATY MEATS INC., Mississauga (CA)

(72) Inventor: Alessandro Girimonte, Mississauga (CA)

( * ) Notice: Subject to any disclaimer, the term of this patent is extended or adjusted under 35 U.S.C. 154(b) by 831 days.

(21) Appl. No.: 17/257,095

(22) PCT Filed: Jul. 5, 2019

(86) PCT No.: PCT/CA2019/050932
§ 371 (c)(1),
(2) Date: Dec. 30, 2020

(87) PCT Pub. No.: WO2020/006645
PCT Pub. Date: Jan. 9, 2020

(65) Prior Publication Data

US 2021/0179312 A1 Jun. 17, 2021

Related U.S. Application Data

(60) Provisional application No. 62/694,486, filed on Jul. 6, 2018.

(51) Int. Cl.
*B65D 1/36* (2006.01)
*B65B 5/10* (2006.01)
(Continued)

(52) U.S. Cl.
CPC ..... *B65D 1/36* (2013.01); *B65B 5/101* (2013.01); *B65B 25/067* (2013.01);
(Continued)

(58) Field of Classification Search
CPC ..... B65D 1/36; B65D 81/2015; B65B 5/101; B65B 25/067; B65B 31/046; B65B 35/24; B65B 57/14
(Continued)

(56) References Cited

U.S. PATENT DOCUMENTS 2,816,038 A 12/1957 Thommen
2,955,044 A * 10/1960 Tupper ..... A23G 9/221 206/820
(Continued)

FOREIGN PATENT DOCUMENTS

DE 20214487 U1 3/2003
JP 2016145071 A 8/2016
(Continued)

OTHER PUBLICATIONS

EPO, Extended European Search Report for EP Application No. 19831395.9 dated May 20, 2022.
(Continued)

*Primary Examiner* — Jacob K Ackun
(74) *Attorney, Agent, or Firm* — Norton Rose Fulbright Canada LLP

(57) ABSTRACT

A tray for receiving sausages is provided. The tray includes cells which are adapted to substantially match the shape of sausages or other soft materials. The tray may be vacuum sealed to cause a relatively uniform top surface suitable for stacking. The tray may be sealed without pre-freezing the sausages and without causing significant deformation to said sausages upon thawing. The tray may be loaded in an automated manner without the use of robotic arms placing individual sausages into the tray.

8 Claims, 13 Drawing Sheets

(51) Int. Cl.

| | |
|---|---|
| ***B65B 25/06*** | (2006.01) |
| ***B65B 31/04*** | (2006.01) |
| ***B65B 35/24*** | (2006.01) |
| ***B65B 57/14*** | (2006.01) |
| ***B65D 81/20*** | (2006.01) |

(52) U.S. Cl.
CPC ..... *B65B 31/046* (2013.01); *B65B 35/24* (2013.01); *B65B 57/14* (2013.01); *B65D 81/2015* (2013.01)

(58) Field of Classification Search
USPC ..... 206/561; 426/119, 129, 392
See application file for complete search history.

(56) References Cited

U.S. PATENT DOCUMENTS

| | | | | |
|---|---|---|---|---|
| 3,508,930 | A * | 4/1970 | Viesturs | A23L 17/40 426/119 |
| 3,683,793 | A | 8/1972 | Garnett | |
| 4,682,387 | A | 7/1987 | Leining | |
| 5,203,142 | A | 4/1993 | Kollross | |
| 5,269,116 | A | 12/1993 | Roberts et al. | |
| 5,770,249 | A * | 6/1998 | Mello | B65D 75/327 206/564 |
| 5,843,500 | A * | 12/1998 | Guarino | B65D 81/203 426/396 |
| 6,119,862 | A * | 9/2000 | Childress | B65D 1/36 426/119 |
| 6,141,943 | A | 11/2000 | Hart et al. | |
| 7,154,073 | B2 | 12/2006 | Iwai et al. | |
| 7,220,176 | B2 | 5/2007 | Hartwick | |
| 9,504,263 | B2 | 11/2016 | Meggelaars et al. | |
| D826,644 | S * | 8/2018 | Bergeron | D7/553.1 |
| D853,794 | S * | 7/2019 | Bergeron | D7/553.2 |
| D853,795 | S * | 7/2019 | Bergeron | D7/553.2 |
| 2003/0170352 | A1* | 9/2003 | Owen | B65D 77/003 426/129 |
| 2007/0045083 | A1 | 3/2007 | Hart et al. | |
| 2011/0124276 | A1* | 5/2011 | Waldrop | A22C 11/008 452/51 |
| 2013/0004625 | A1* | 1/2013 | Brummer | B65D 77/02 53/448 |
| 2018/0206510 | A1 | 7/2018 | Greif et al. | |
| 2019/0375534 | A1* | 12/2019 | Bergeron | B65B 25/065 |

FOREIGN PATENT DOCUMENTS

| | | | |
|---|---|---|---|
| JP | WO2017018531 | A | 5/2018 |
| KR | 200410098 | Y1 | 3/2006 |
| WO | 2008065807 | A1 | 6/2008 |
| WO | 2011062754 | A1 | 5/2011 |

OTHER PUBLICATIONS

WIPO, International Search Report and Written Opinion for PCT Application No. PCT/CA2020/050414 dated Jun. 4, 2020.
WIPO, International Search Report and Written Opinion for PCT Application No. PCT/CA2019/050932 dated Sep. 17, 2019.
WIPO, International Preliminary Report on Patentability for PCT Application No. PCT/CA2020/050414 dated Sep. 28, 2021.
EPO, Partial supplementary search report for EP 20779082.5 dated Dec. 5, 2022.
EPO, Partial Search Report for EP Application No. 19831395.9 dated Feb. 2, 2022.

* cited by examiner

SAUSAGE TRAY AND PACKAGING METHOD

FIELD

This relates to trays for soft solid materials, such as fresh meats, and to sealed arrangements containing said trays and methods of loading said trays.

BACKGROUND

Currently, soft materials, such as fresh meats (e.g. sausages), are typically sold to consumers in paper bags or vacuum sealed packages. Although this specification refers specifically to sausages, it is to be understood that the embodiments described herein are applicable to other soft meats and soft materials.

Paper bags are suitable for small quantities of sausages, but cannot be scaled up to larger quantities of sausages. Stacking paper bags would result in sausages in the lower levels being crushed and/or deformed, and unappetizing at best. Moreover, paper packaging is not air-tight and thus represents an inefficient use of space, and increases the likelihood of the sausages spoiling.

Another method of packaging sausages is placing sausages on a tray and performing a vacuum sealing process using, for example, a plastic sealing pouch. Vacuum sealing represents an improvement over paper packaging, as the sausages can be packed more tightly, thus saving space, and in an air-tight manner. However, soft materials such as sausages are easily deformed. As such, the vacuum sealing process causes the sausages to be crushed and/or deformed as the air is removed from the package.

One method for alleviating this problem is to freeze sausages prior to packaging them. For example, sausages can be frozen in advance of packaging, and then frozen, rigid sausages can be placed on a flat tray to be sealed. The cylindrical shape of the frozen, rigid sausages may be more closely preserved during vacuum sealing to avoid crushing (see, for example, FIGS. 1A, 1B, 1C and 1D).

However, the pre-freezing process is energy-intensive, and takes a substantial amount of time before sausages are adequately frozen to be vacuum sealed with reduced deformation. Moreover, the frozen, packaged sausages have to be kept frozen. That is, they must be transported in trucks with cooling units, which represents further wastes of energy, and must be kept frozen at retailers. Further, when presented on display at retailers, these packages have a non-uniform, irregular shape. This is not aesthetically pleasing to customers.

As can be seen particularly in FIG. 1B, the frozen sausages 2 in package 1 are quite bulbous, and the resulting top surface of the package 1 is uneven, with many undulations and ridges. As such, applying a label 4 to the package is cumbersome, since the surface is not close to being flat. Moreover, if a consumer wishes to purchase multiple packages 1, the packages 1 do not stack easily, because the flat tray 3 does not have any stability when placed on top of the uneven top surface of another package. Thus, the customer experience is somewhat "messy" when using package 1.

In addition, it is impossible to achieve a perfect seal between the frozen sausages and the wrapping material. As can be seen in FIG. 1A, there are many areas in which there are air pockets 5. These air pockets 5 allow frost to form on the sausages, which negatively impacts the quality of the sausage. Moreover, when the sausages are finally thawed by the end user for consumption, they may still be somewhat deformed, which may be unappetizing for consumers, and can be bothersome to consumers who place value on the "presentation" of foods.

Further, as a consequence of the requirement to freeze sausages, it is difficult or impossible to ship fresh sausages to customers (e.g. on the same day the sausages are made), because the freezing and packaging processes take too much time. This implies that sausage manufacturers located away from urban centres are at a competitive disadvantage to local butchers (who may be able to deliver small quantities locally through less efficient packaging means).

In addition, the loading of known tray 3 with sausages 2 is quite cumbersome. Sausages must be loaded manually onto tray 3, and in a fairly haphazard manner, which is labour intensive and inefficient.

There is a need for systems and processes which reduce or eliminate one or more of the above-noted disadvantages associated with present systems.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

According to an aspect, there is provided a tray for sausages.

According to another aspect, there is provided a method for loading sausages into a tray.

Other features will become apparent from the drawings in conjunction with the following description.

BRIEF DESCRIPTION OF DRAWINGS

In the following figures, dimensions of components are chosen for convenience and clarity only and are not necessarily shown to scale. Embodiments of the invention will now be described in greater detail with reference to the accompanying figures, in which.

DETAILED DESCRIPTION

Figure 1B:
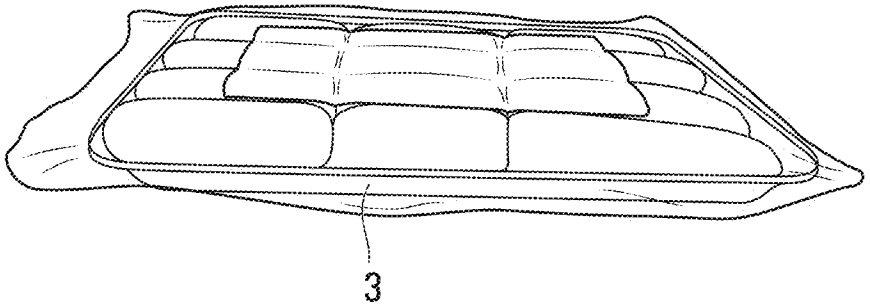
FIG. 1B is a side-oriented view of the tray of FIG. 1B.

Various embodiments illustrate a tray for stacking, transporting, displaying, and selling packages filled with sausages and other soft materials. Though the following description makes frequent reference to "sausages" in connection with one or more embodiments, it should be appreciated that embodiments could also or instead be used in association with other soft materials, such as other meats, soft cheeses, and/or breads.

FIGS. 2-6 are views of an example embodiment of a stackable tray for sausages in accordance with one embodiment. In some configurations, the tray is shown with sausages filling one more portions, and in some configurations the tray is shown without sausages filling any portions. In some configurations, one or more trays are stacked, and in some configurations one or more trays are nested. It should be appreciated that the embodiments shown in FIGS. 2 to 6 are intended solely for illustrative purposes, and that the present invention is in no way limited to the particular example embodiments explicitly shown in the drawings and described herein.

Figure 2:
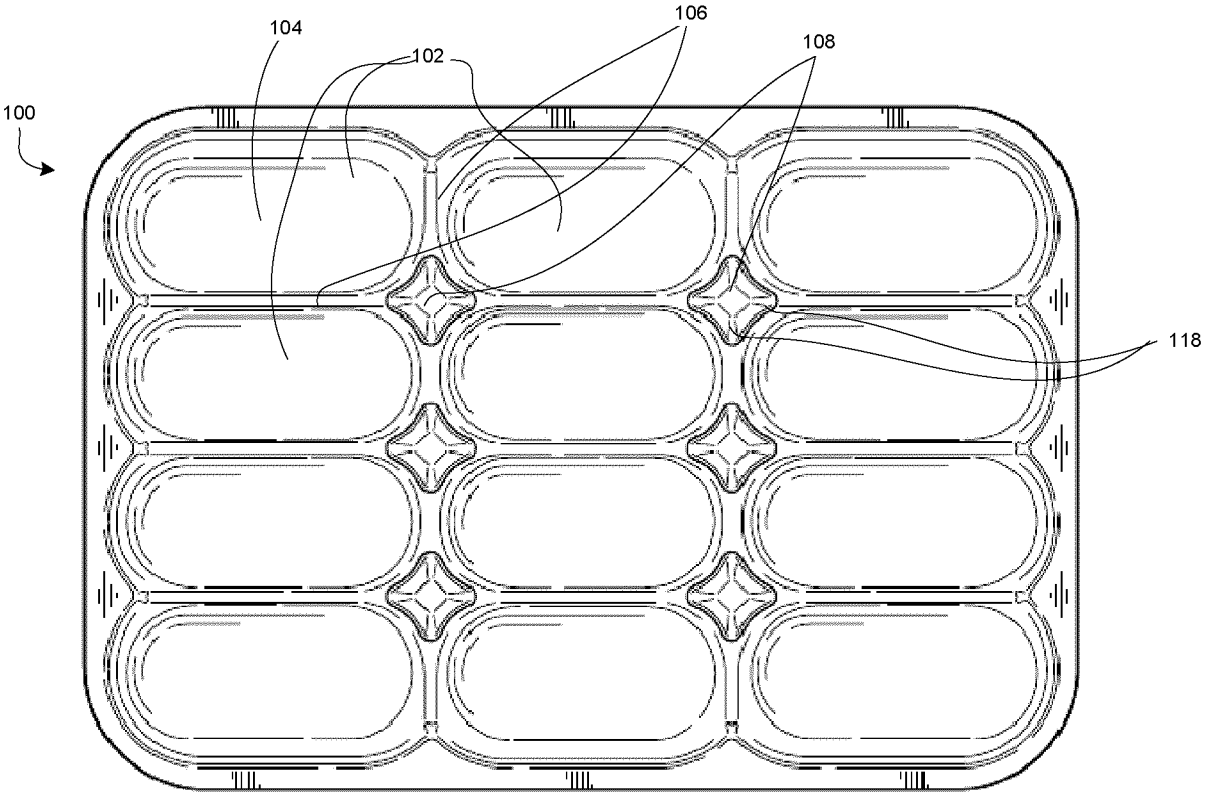
FIG. 2 is a top view of a tray for sausages according to some embodiments.
Figure 3:
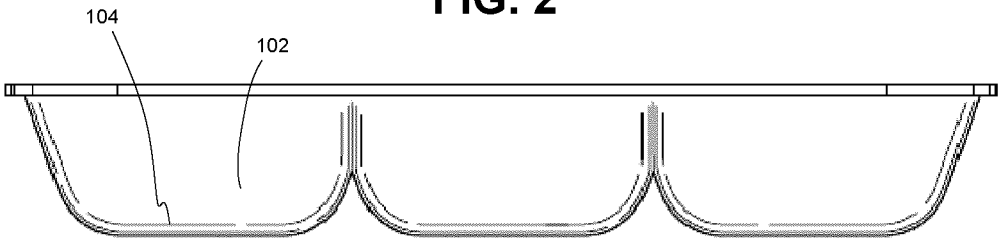
FIG. 3 is a side view of the tray of FIG. 1.

Referring to FIG. 2, tray 100 comprises a tray body comprising an outer top surface 112 provided with an array of one or more recessed cells 102 for receiving sausages. Each cell 102 may comprise a seat 104 and reinforcement ribs 106 which may surround the seat 104. The tray 100 may further include base support columns 108, which culminate in a top surface 110. The base support columns 108 are generally formed at intersections of reinforcement ribs 106. The cell 102 may be shaped to receive one or more sausages. Though cell 102 is depicted as having a substantially semi-cylindrical shape, this is not essential as other shapes may be employed. Moreover, the tray 100 can be configured and dimensioned differently so as to accommodate different sausage shapes and sizes, and/or a different number of sausages than the 12 cells 102 shown in FIGS. 2 to 6.

Figure 5:
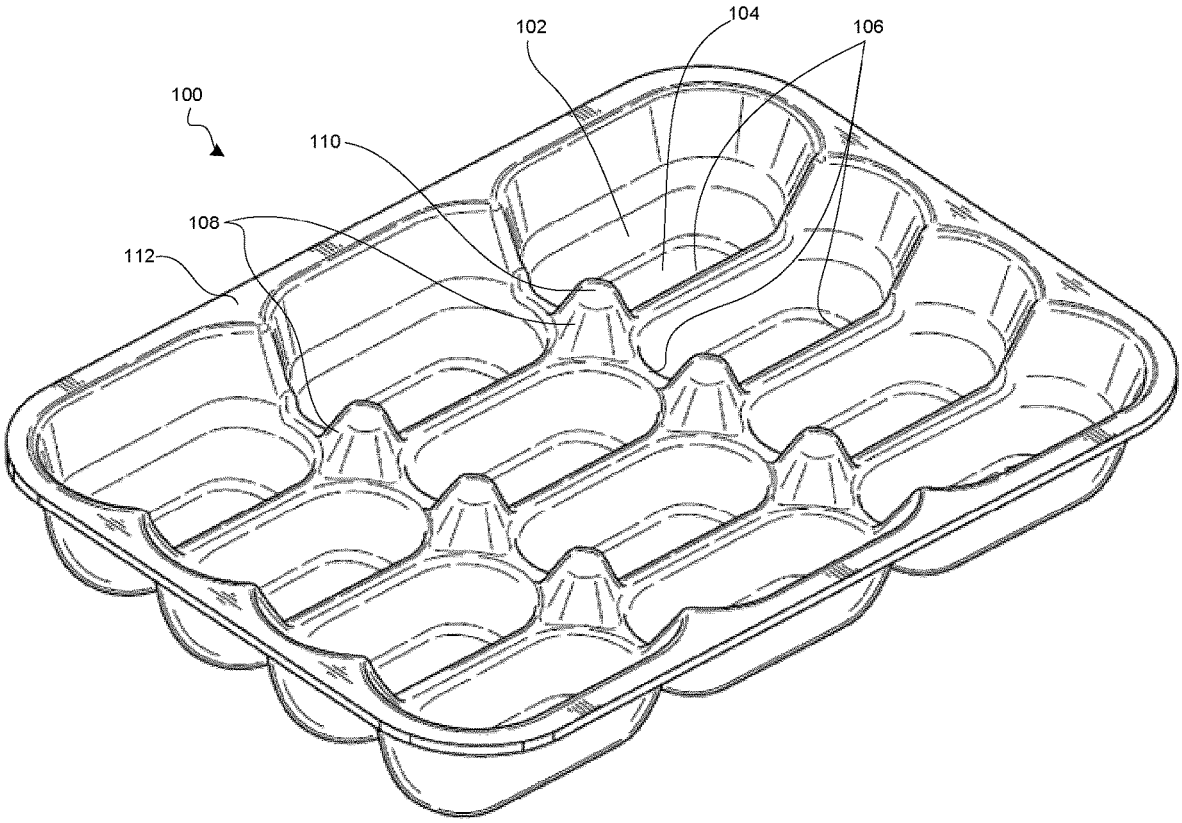
FIG. 5 is a perspective view of the tray of FIG. 1.

As depicted in FIG. 5, the vertical height of the reinforcement ribs 106 may be vertically lower than the height of the outer top surface 112. In some embodiments, the top surface 110 is substantially horizontal and flat. In some embodiments, the height of the top surface 110 is substantially similar to the height of the outer top surface 112. In some embodiments, the height of the top surface 110 is vertically lower than the height of the outer top surface 112.

The shape employed for cell 102 is dictated by the shape and size of the product (i.e. sausage or other soft material) to be accommodated, so as to effectively utilize space on tray 100 while maintaining structural integrity and functionality of the tray 100. Sausages are normally substantially cylindrical in shape and manufactured in "links". In some embodiments, the longitudinal length of cell 102 may be substantially equal to the length of a sausage, such that a sausage may lay flat across the cell 102 on its side (see, e.g., FIG. 7). In some embodiments (not shown), the seat 104 may be configured to receive two or more sausage placed alongside one another. In some embodiments, the seat 104 is contoured so as to accommodate a single sausage without warping the shape of the sausage.

Figure 7:
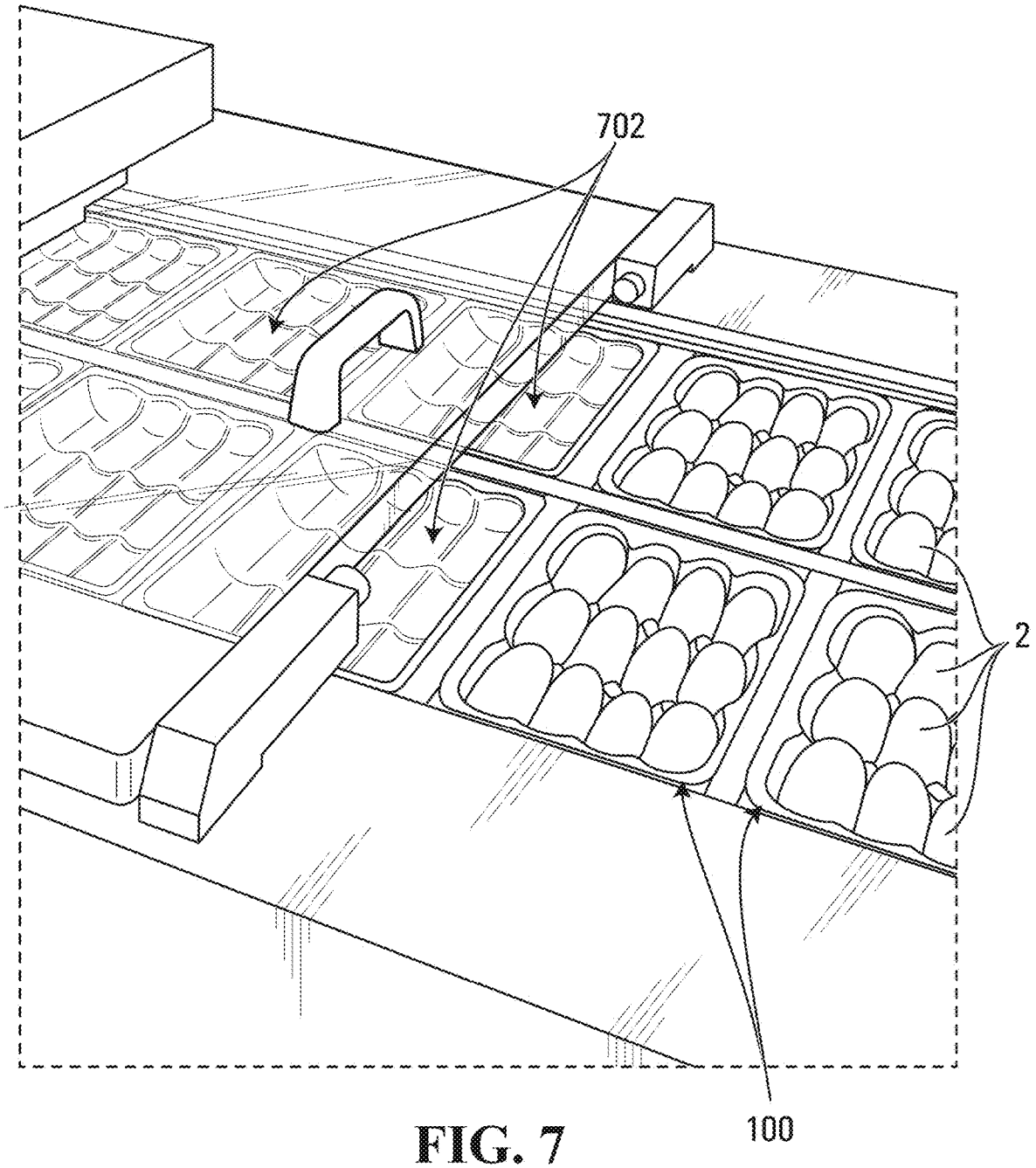
FIG. 7 is a perspective view of the tray of FIG. 1 when loaded with a plurality of sausages prior to sealing.

It will be appreciated that in embodiments in which the shape of cell 102 substantially matches or is substantially complementary to the shape of a lower half of a sausage, there is minimal risk of permanent deformation on the underside of the sausage, and pre-freezing the sausages prior to placing them in the cell 102 of tray 100 is unnecessary. As shown in FIG. 7, the sausages may be placed into tray 100 fresh, without any pre-freezing step. As such, the pre-freezing stage of the conventional sausage packaging process may be bypassed, thus saving both time and energy, when sausages are stored in the tray 100.

Both the stability of the tray and the degree to which sausages may be deformed while resting in the tray 100 may be enhanced when the cells 102 have a shape which is complementary to the shape of the sausages. This can assist with both lateral stability and axial stability in keeping stacked trays aligned.

Reinforcement ribs 106 may surround the seat 104 and may be shaped and sized to provide rigidity and stability to the tray 100. The base support columns 108 may also provide structural, mechanical and functional support to tray 100 to prevent the tray 100 from warping or buckling, and to distribute surface tension from any wrapping material used for vacuum packing, as described in further detail below, to aid in avoiding excess forces being applied to the sausages to avoid deformation of the sausages.

Figure 6:
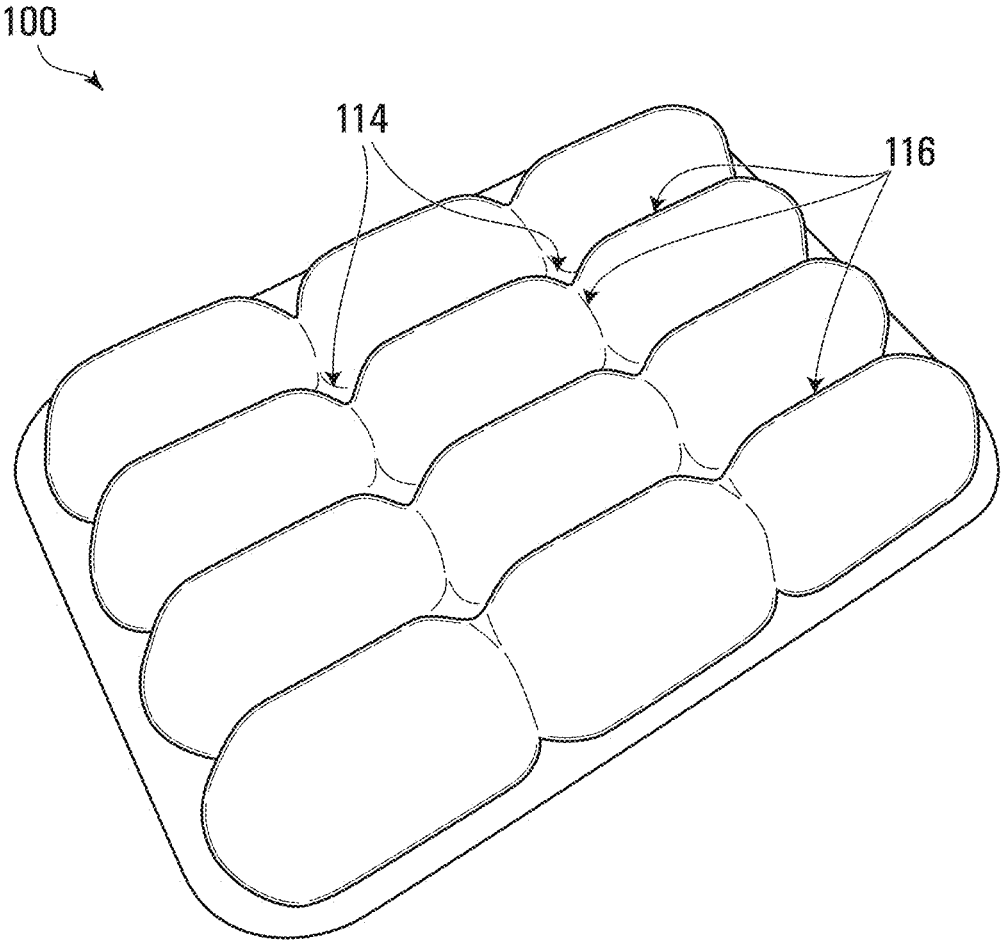
FIG. 6 is a photograph of the underside of the tray of FIG. 1.

The base support columns 108 may be arranged to protrude upwardly from areas between adjacent cells 102. The base support columns may be either vertically protruding, or protruding with a varying slope or slant. As shown in FIG. 6, the underside of the tray 100 may include receptors 114 which are complementary in shape to the base support columns 108, and any teeth 118 on top surface 110, as well as rib grooves 116. This relationship allows for convenient nesting of multiple unloaded trays. In some embodiments, the top surface 110 is smooth and does not include teeth 118, and the underside of the tray does not include receptors complementary in shape to teeth 118 (as depicted in FIG. 6).

Base support columns 108 may be integral with reinforcement ribs 106 and/or seat 104, but may also be separable from the tray 100. The base support columns, if not formed integrally with tray 100, may be made of a different material than tray 100. The shape of base support columns 108 may be wider at the lower end and become increasingly narrow towards top surface 110. The base support columns 108 may also be hollow so as to allow for nesting of a first tray with another tray above or below the first tray. Base support columns 108 may also, when trays are nested, prevent lateral movement of the trays. Different base support columns 108 on tray 100 may be different shapes and/or heights. In some embodiments, each base support column 108 has the same shape and height.

Top surface 110 may have any suitable texture or shape. In some embodiments, top surface 110 comprises one or more teeth 118 which have a shape complementary with tooth receptors on the underside receptors 114 of tray 100. In some embodiments, the teeth 118 on a first empty tray 100 may, when nested with a second tray 100, fit into tooth receptors on the second tray and provide a friction fit.

Figure 4:
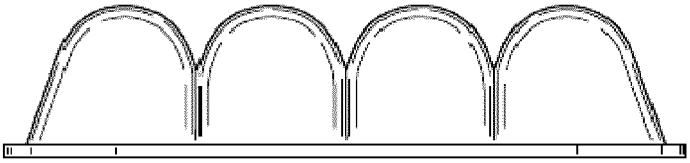
FIG. 4 is a front view of the tray of FIG. 1.

As shown in FIG. 2, more than one cell 102 may be provided. Specifically, the outer top surface 112 may include two or more cells 102 (FIG. 4 depicts 12 cells 102), which may be substantially the same size or may differ at least in size. For example, tray 100 may be provided with an array of cells 102 which differ in size from one another. For example, one cell 102 may be dimensioned to fit two sausages, while another cell 102 may be dimensioned to fit one sausage.

The tray 100 may be made of a single material (e.g. plastic), and in particular may be made from a variety of processes (e.g. injection molding, compression molding, thermoforming, or the like). Plastics may include any known variants of polyethylene or polystyrene, as well as metals, papers, or combinations thereof. The tray 100 may also be made from a composite of separate materials joined together.

In some embodiments, the tray 100 is a plastic molding in which the top surface and bottom surface are complementary surfaces (i.e. receptors 114 are the underside of base support columns 108, rib grooves 116 are the underside of reinforcement ribs 106, and the like). It will be understood that in embodiments in which different base support columns 108 have different shapes (e.g. cross-sectional shape, height, and/or width), in order to achieve optimal nesting capabilities, trays 100 used for nesting should have similar or identical dimensions.

As noted above, and as depicted in FIG. 7, the cells in tray 100 are dimensioned and shaped to receive soft food items (e.g. sausages). FIG. 7 is a perspective photo of a tray 100 which has been loaded with sausages. As can be seen, the sausages fit into each individual cell. Because fresh sausages are soft and deformable, the cells 102 can accommodate sausages with varying shapes and dimensions (that is—the tray 100 can accommodate some variation in the size of each individual sausage, without requiring all sausages to be identical). The sausages in FIG. 7 are fresh sausages and are not frozen. Tray 100 can be loaded with fresh sausages without any pre-freezing step. Moreover, the dimensions and shape of tray 100 may allow for novel and inventive methods of loading fresh sausages into tray 100. As noted above with respect to known tray 1, sausages are required to be loaded manually. Tray 100 facilitates more efficient methods and processes for loading tray 100 with fresh sausages.

Figure 8A:
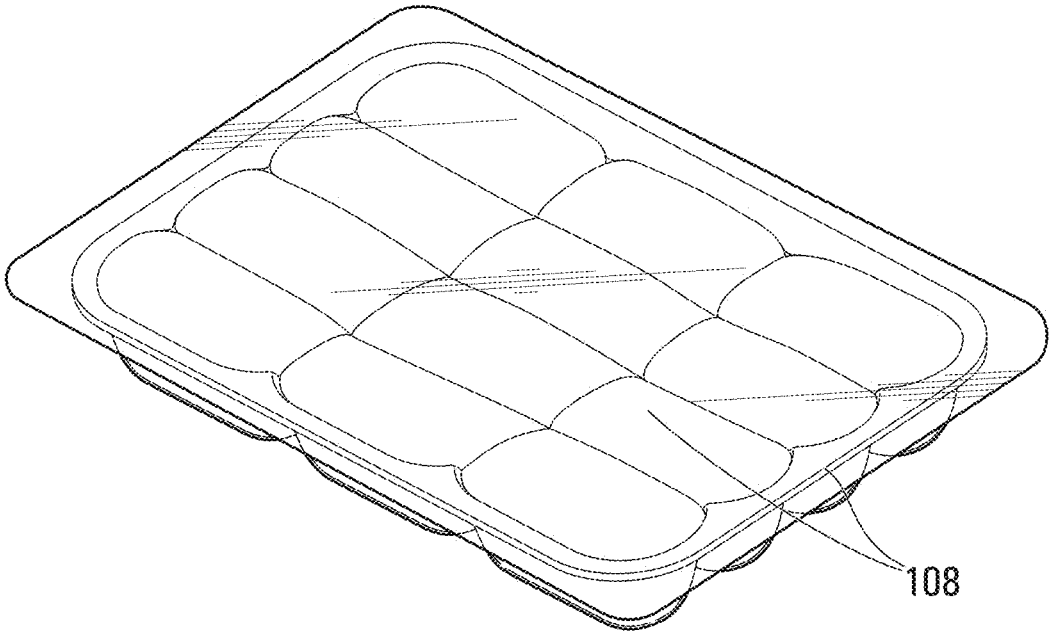
FIG. 8A is a perspective view of the tray of FIG. 1 when loaded with a plurality of sausages and vacuum sealed.
Figure 8B:
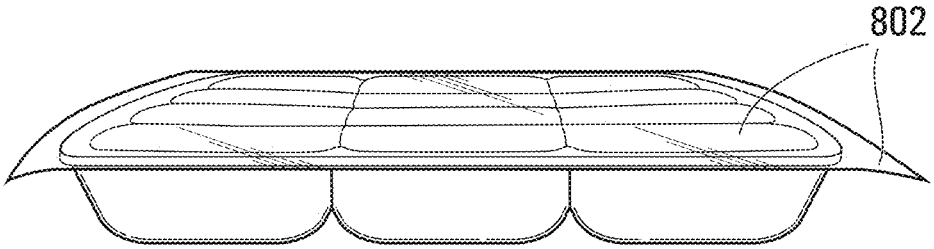
FIG. 8B is a side-oriented view of the tray of FIG. 8A.

After loading tray 100 with fresh sausages, the tray 100 may be sealed. As shown in FIG. 7, adjacent to the tray 100 is a plastic pouch 702 which may be bonded and sealed to tray 100. It will be appreciated that the bottom side of the pouch 702 has a form which is substantially similar to the underside of tray 100. The pouch 702 is placed around the tray 100 and is subsequently sealed. The sealing process may be, for example, a thermal sealing process in which air is vacuumed out of the pouch and the pouch 702 bonds to the upper surface 112 of tray 100. FIGS. 8A and 8B illustrate a sealed pouch 702 which contains tray 100 loaded with sausages.

It will be appreciated that it is theoretically possible to simply place sausages directly in pouch 702, without using tray 100, and then to vacuum seal the pouch 702. In fact, during development of the present invention, the inventors were advised that there was no need for a tray 100, and that the concept of using a tray 100 within pouch 702 would be redundant and a waste of material, given that sausages could be placed directly into pouch 702 rather than using a tray. However, the inventors found that the use of tray 100 resulted in numerous unexpected advantages, which are described herein.

FIG. 8A is a perspective view of a sealed arrangement 800 including tray 100 loaded with sausages. The sealed arrangement 800 may result from applying the pouch 702 to the loaded tray 100 in FIG. 7 and vacuum sealing the pouch around the tray 100. It will be appreciated that the upper surface 802 of the sealed arrangement 800 is substantially flat. Contrastingly, it will be appreciated that in FIG. 7, each fresh sausage 2 is somewhat bulbous and protrudes from the cell 102 of tray 100 in which the sausage 2 is stored, and there is ample spacing between individual fresh sausages 2.

When vacuum sealing is applied to the pouch 702, the pouch tightens around the top surface 112 and the underside of tray 100. In so doing, the fresh sausages 2 are compressed. In some embodiments, the effect of this compression on the sausages 2 is a substantially continuous upper surface 802 with substantially no open space between sausages. As shown in FIGS. 8A and 8B, the fresh sausages are capable of deforming under the pressure of vacuum sealing to fill any space which remains between tray 100 and upper surface 802 of the pouch 802. This upper surface offers numerous unexpected advantages over other tray designs.

First, it should be noted that the above-noted vacuum sealing process can be conducted using fresh sausages. As noted above, prior trays required the sausages to be frozen prior to vacuum sealing the tray. With prior trays, any attempt to vacuum seal fresh sausages would result in the sausages squirting out of the tray, or being crushed by the sealing to the extent that the sausages could not regain their regular shape after removal from the tray.

Contrastingly, in some embodiments, the tray 100 allows for the pre-freezing step to be avoided. This represents a substantial improvement in efficiency and in the possibilities for selling fresh sausages. For example, the time required to pre-freeze the sausages to a desired level of rigidity may be avoided using tray 100, thus reducing the length of production cycles. Moreover, inventory costs may be reduced by reducing the need for freezer space required by the pre-freezing step. This may also allow sausage producers to produce and package fresh sausages for sale on the same day, rather than having to freeze sausages and then sell the sausages from frozen the following day.

Moreover, when the arrangement 800 is subsequently opened (e.g. by a consumer) after the vacuum sealing, the sausages 2 are sufficiently resilient to substantially regain their original shape. That is, the sausages can regain their original shape with little or substantially no permanent deformation. In some embodiments, the sausages may regain from ⅞ of their original shape to a full regaining of the original sausage shape. This would not be possible with previous tray designs—which result in the sausages being deformed and disfigured, and thus less attractive to the end user. The cells 102 in tray 100 are dimensioned so as to substantially maintain the original cylindrical shape of the sausages 2 prior to freezing. Contrastingly, a flat tray would not provide any support for maintaining the shape of the fresh sausage.

Figure 1A:
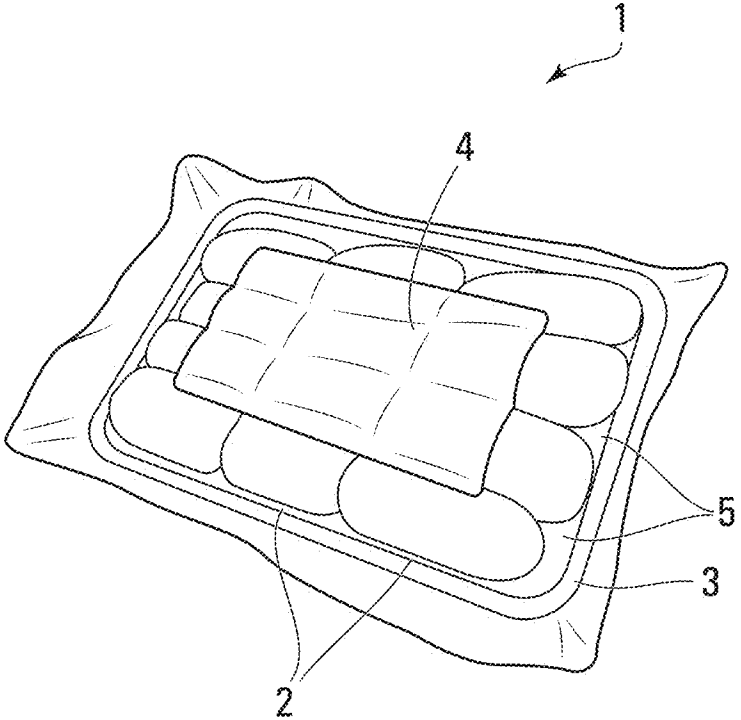
FIG. 1A is a perspective view of a tray for sausages.
Figure 1D:
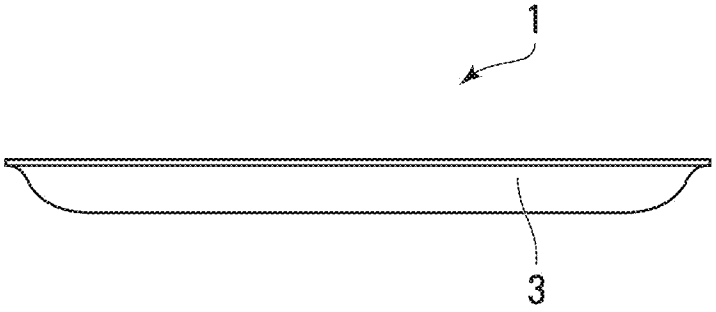
FIG. 1D is a side view of the tray of FIG. 1C.
Figure 1C:
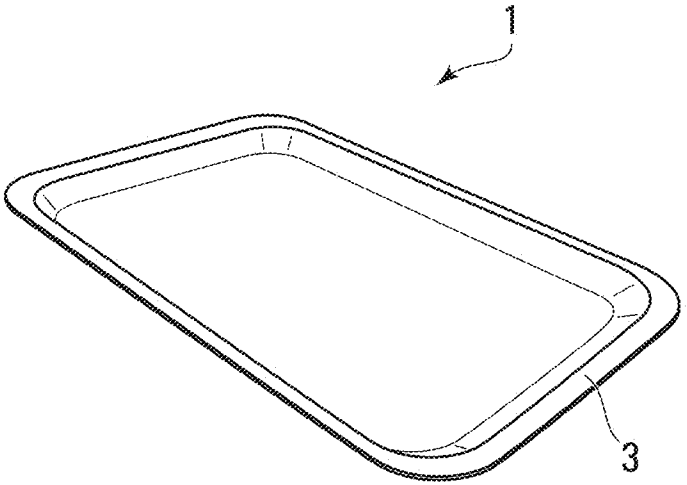
FIG. 1C is a perspective view of the tray of FIG. 1A when unloaded.

As a further advantage, it should be appreciated that the sealed arrangement 800 includes substantially no air pockets between sausages. Relative to the tray in FIGS. 1A and 1B (which contains numerous air pockets 5 when sealed), the tray 100 may allow for more efficient packing of sausages. Moreover, should the sealed arrangement 800 be subsequently frozen after sealing (e.g. for longer term storage and/or transportation to commercial selling locations), the reduction in air pockets may also reduce the likelihood of frost or "freezer-burn" occurring within the package, thus improving the quality of the sausages 2 when ultimately consumed by the end user.

Using at least two trays 100 it may be possible to create a stacked arrangement of loaded trays, where a first cell 102 of a first tray 100 receives a sausage. Normally, all cells 102 in a first tray would be occupied by sausages and vacuum sealed before a second tray is placed on top of the first loaded, sealed tray. However, it is not strictly necessary for all cells 102 in the first tray 100 to be occupied.

As seen in FIG. 8B, the upper surface 802 of sealed arrangement 800 is fairly flat. In embodiments in which the sausages are fresh, sealed arrangements are easily stacked without the sausages being damaged. For example, the weight of sealed arrangements 800 stacked on top of a base sealed arrangement is dispersed throughout the material used for the upper surface 802, and the sausages cannot deform in any appreciable way under the weight of other trays.

Moreover, in embodiments in which the sealed arrangement is subsequently frozen after sealing, the relatively flat upper surface 802 of sealed arrangement 800 provides a fairly even surface for stacking. While not perfectly flat, sealed arrangements 800 may be stacked with a high degree of stability. It is clear from FIGS. 1A and 1B that the previous tray configurations contained substantial variations in depth and surface contours on the upper surface, because the sausages are pre-frozen to maintain a somewhat cylindrical shape. This variation in upper surface results in fairly clumsy stacking arrangements in view of the flat shape of the underside of the prior tray. It is much easier for a flat try to slide and fall off from an uneven surface in any of a number of directions than it is for a tray with multiple recessed cells. Moreover, stacking multiple levels of the prior trays of FIGS. 1A and 1B results in a compounding of the instability from the stacking of one level of trays. This is an important feature in terms of in-store displays. Consumers tend to be attracted to packaging which is neat and organized, and as such the tray 100 may be more attractive to consumers in a display setting because the trays stack in a stable and organized manner.

Figure 9A:
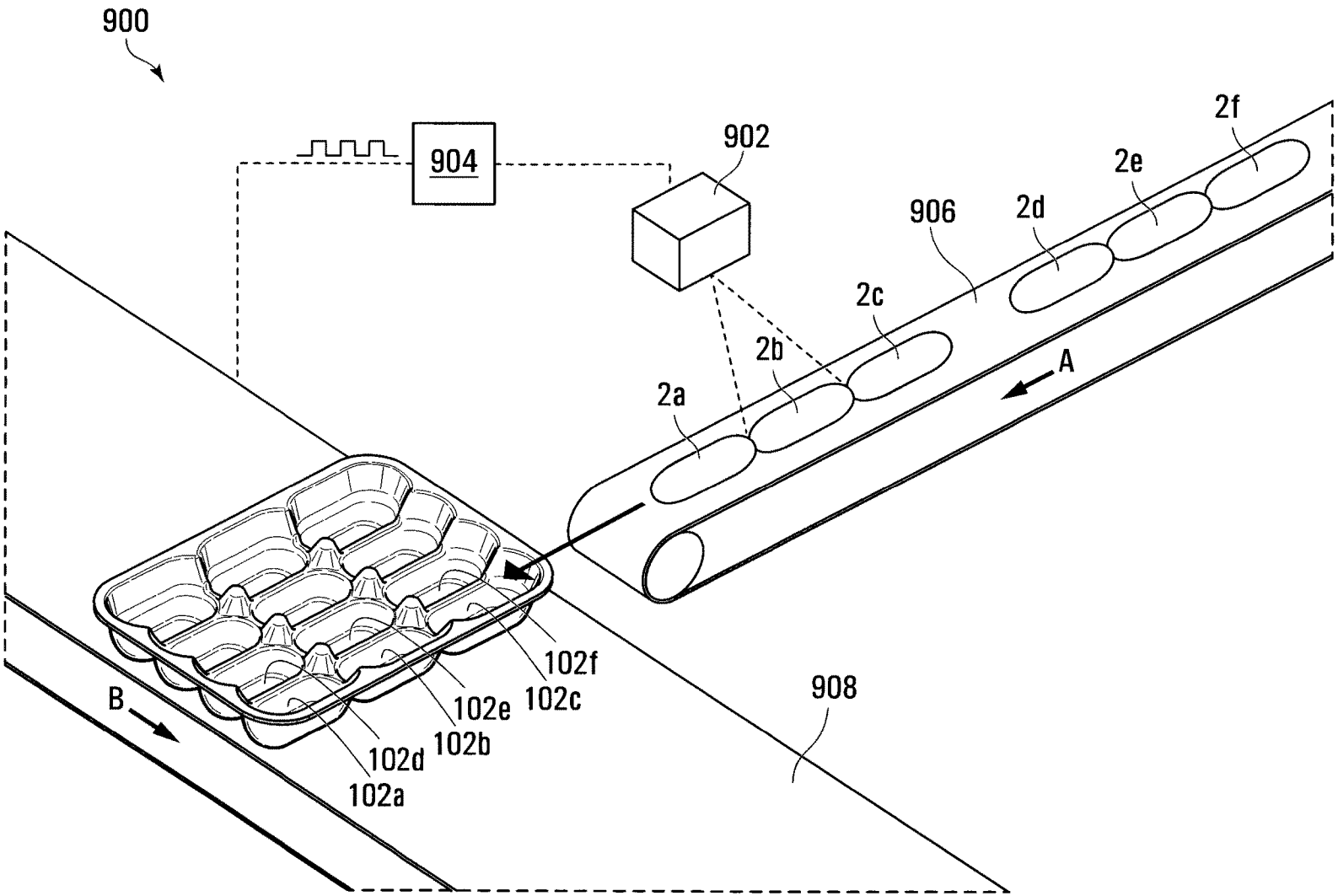
FIG. 9 is a diagram depicting an example process for loading a tray with sausages.
Figure 9B:
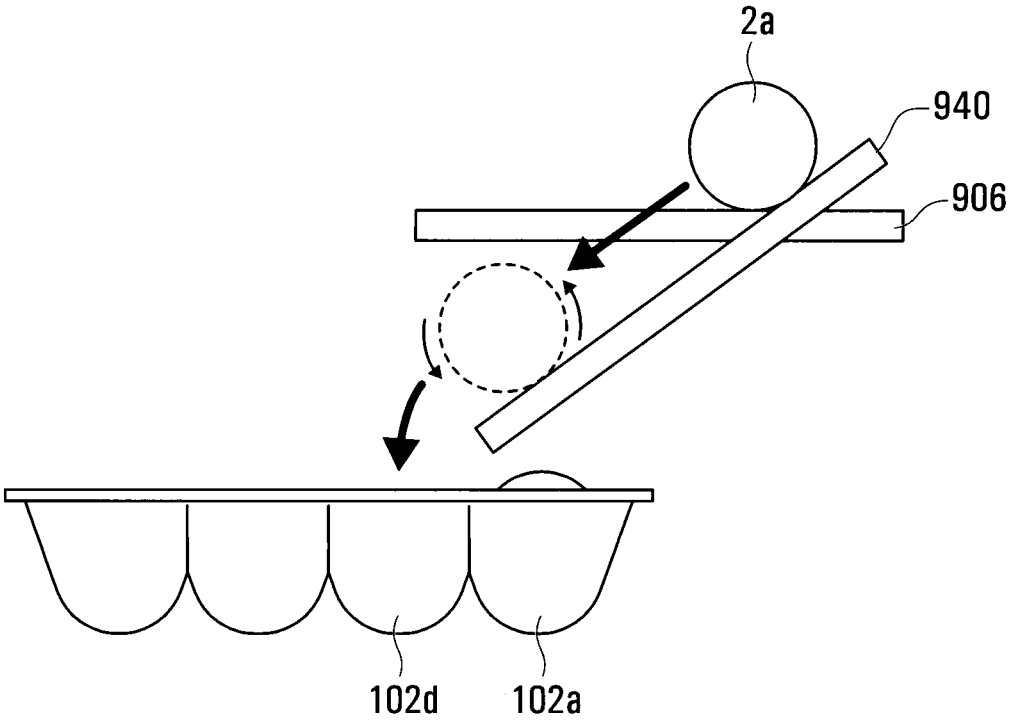
Figure 9C:
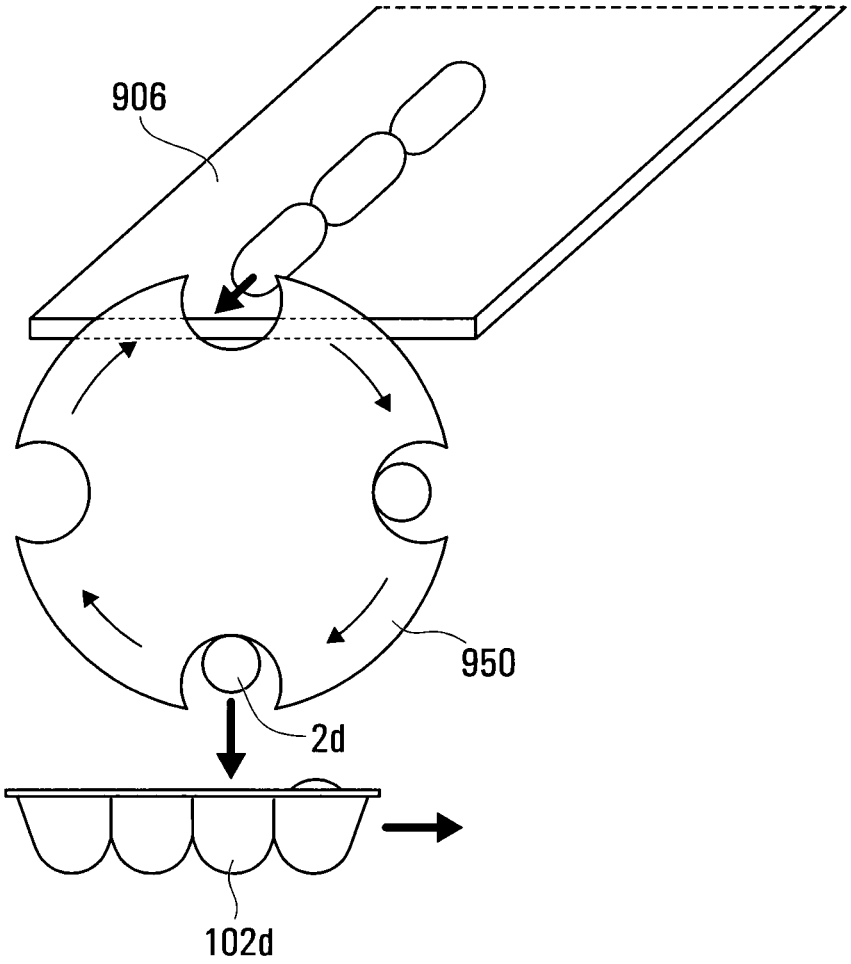

Various embodiments described herein may be used in conjunction with systems and methods for loading a tray with sausages or other soft materials. FIG. 9 is a perspective view depicting an example system for loading tray 100 with fresh sausages. It will be appreciated that the system depicted in FIG. 9 is merely an example and that other variants are contemplated.

As depicted, system 900 includes a processor 904, a sensing device 902, a sausage conveyor 906, and a tray conveyor 908. Sausage conveyor 906 is configured to move sausage links 2*a*, 2*b*, 2*c* and 2*d*, 2*e*, 2*f* in direction A at a predetermined speed. Tray conveyor 908 is configured to move tray 100 in direction B. In some embodiments, the tray conveyor may provide pulsed movement. For example, a motor driving tray conveyor 908 may operate in accordance with a duty cycle (illustrated as a square wave in FIG. 9) calculated and provided by processor 904, meaning the tray is stationary for a period of time, and is then moved for a period of time at a given speed. In some embodiments, there is a jerk or jarring movement associated with the start-and-stop pulsing of a duty cycle.

In operation, the sausage links 2*a*, 2*b* and 2*c* are propelled by sausage conveyor 906 in the longitudinal direction with sufficient velocity so as to cause sausage 2*a* to land in the vicinity of cell 102*a* in tray 100. In some embodiments, a sloped surface is provided between the sausage conveyor and the tray conveyor. The sausages may deflect off the sloped surface so as to impart lateral motion to the sausages. In some embodiments, sausage links 2*a*, 2*b*, 2*c* may be connected by links. In other embodiments, sausage links 2*a*, 2*b*, 2*c* may be separate from one another. The calibration and selection of the appropriate speed for launching sausages 2*a*, 2*b*, 2*c* into the cells 102*a*, 102*b* and 102*c* of tray 100 will depend on the particular configuration of a given system, but can be calibrated. It will be appreciated that the speeds and distances involved will vary with different shapes and sizes of sausages.

In embodiments in which sausage links are connected, the linkage between individual sausages may facilitate the subsequent landing of sausage 2*b* into cell 102*b* after sausage 2*a* has landed substantially in cell 102*a*. Likewise, the position of sausages 2*a* and 2*b* in cells 102*a* and 102*b*, respectively, may facilitate the landing of sausage 2*c* into cell 102*c*.

In embodiments in which sausages are not linked, the presence of sausage 2*a* in cell 102*a* may still provide a degree of facilitation of placing sausage 2*b* into cell 102*b*, since sausage 2*b* may bump into sausage 2*a* while being projected from sausage conveyor 906.

After sausages 2*a*, 2*b* and 2*c* have landed substantially in cells 102*a*, 102*b* and 102*c*, tray conveyor 908 may be actuated to move tray 100 laterally in direction B. Preferably, the tray 100 is moved by a distance substantially similar to the width of cells 102*a*, 102*b*, and 102*c*. Thus, the next set of sausage links 2*d*, 2*e*, 2*f* will be propelled by the sausage conveyor 906 into the next column of cells 102*d*, 102*e*, 102*f*.

In some embodiments, the duty cycle or speed at which tray conveyor 908 moves tray 100 is determined in part by a sensing device 902. The sensing device 902 may, for example, detect the presence of sausages or a particular number of sausages, and communicate this sensing data to processor 904. Processor 904 may in turn send a signal to the motor driving tray conveyor 908 to move at a certain speed or to adjust a duty cycle so as to ensure synchronization between the incoming sausage links from sausage conveyor 906 and open cells 102 in tray 100.

In some embodiments, sensing device 902 may be an optical sensor. For example, the optical sensor may send a first signal when no sausages are visible, and send a second signal when sausages are detected. The length of time between first and second signals may be used to determine an appropriate speed or duty cycle for tray conveyor 908 in order for tray 100 to receive the incoming sausages.

It will be appreciated that sausages do not have identical shapes and that some variation will be present. As such, sausages may not fall perfectly into cells 102*a*, 102*b*, 102*c*. It has been found that if a duty cycle is used for tray conveyor 908, the jerking motion during tray movement may assist with causing the sausages to fall into the correct cell. Because the cells 102*a*, 102*b* and 102*c* are shaped to substantially match the shape of sausages 2*a*, 2*b*, 2*c*, and because the tray 100 includes ribs 106, a sausage which does not land perfectly within a particular cell may fall into place after the pulse of lateral movement provided by the tray conveyor 908 when the tray is moved to the next position.

This may provide substantial advantages over prior systems, which required either the manual placement of sausages into a tray, or the use of robotic arms to detect and place sausages in a certain manner. It will be appreciated that building and customizing a robotic system is prohibitively expensive and impractical for most circumstances. Moreover, it will be appreciated that reducing the cost of labour associated with having employees manually place sausages into a tray would be advantageous for a business. For example, rather than having 6 employees manually placing sausages into trays, the system of FIG. 9 may instead be sufficient to function with 1 employee for quality control (in the event that a sausage fails to fall into a cell perfectly, after the pulse from conveyor tray 908).

Thus, the systems and methods described herein provide for numerous improvements in efficiency and many advantages over conventional tray systems.

Figure 10C:
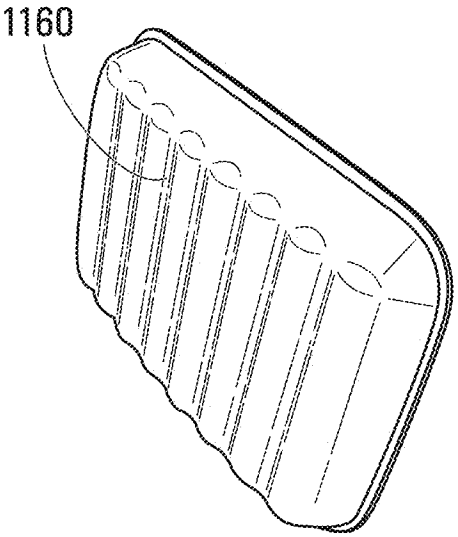
FIGS. 10A, 10B and 10C are views of an alternative embodiment of a tray for sausages.
Figure 10B:
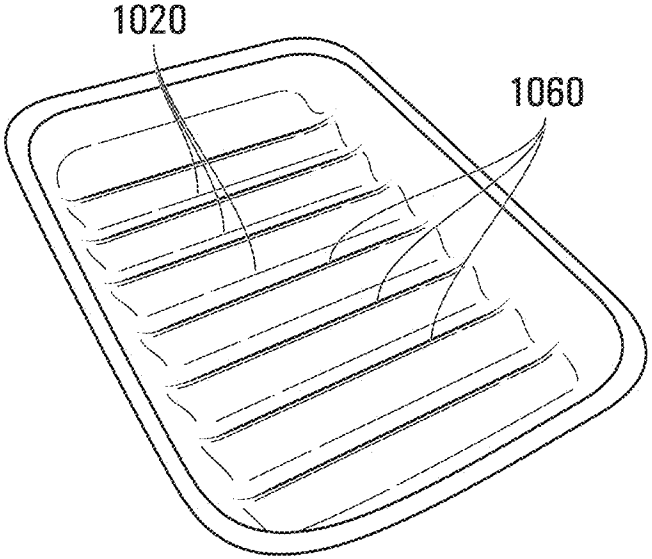
Figure 10A:
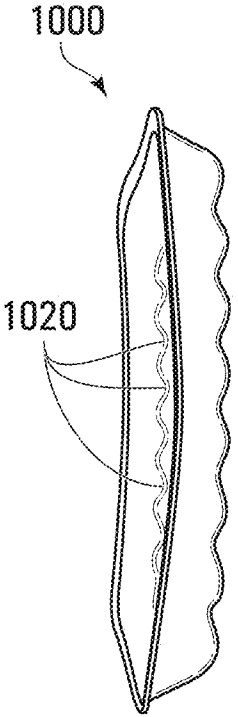

In addition, further embodiments are contemplated, in particular for different shapes of sausages. For example, FIGS. 10A and 10B are side and perspective views of a tray 1000 which is adapted to receive longer, narrower sausage (for example, hot dogs). The cells 1020 are configured to receive hot dogs and the ribs 1060 provide similar structural and functional benefits as ribs 106 described above. FIG. 10C is a perspective view of the underside of tray 1000, illustrating the corresponding shape of rib grooves 1160 to ribs 1060. Tray 1000 may be loaded with fresh sausages in a manner similar to tray 100 described above, and may be vacuum sealed in a manner similar to that which is described above.

Figure 11B:
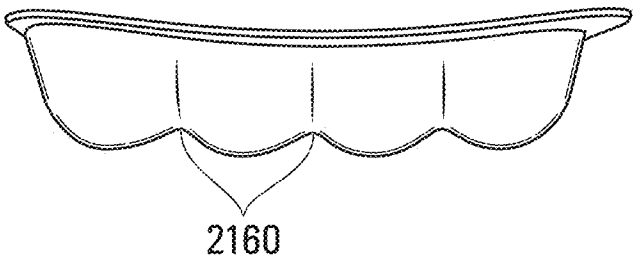
FIGS. 11A and 11B are views of an alternative embodiment of a tray for sausages.
Figure 11A:
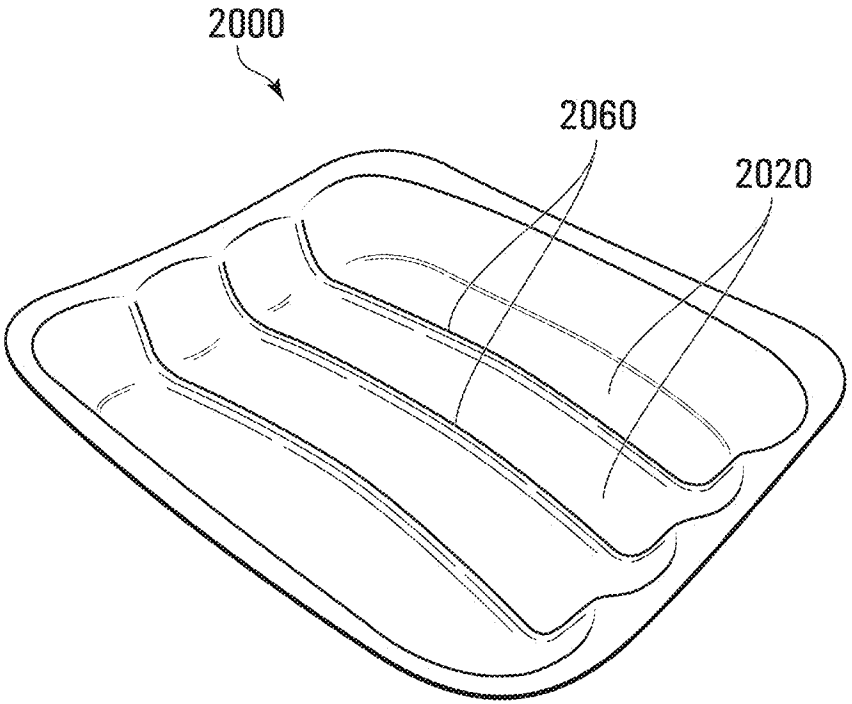
Figure 12B:
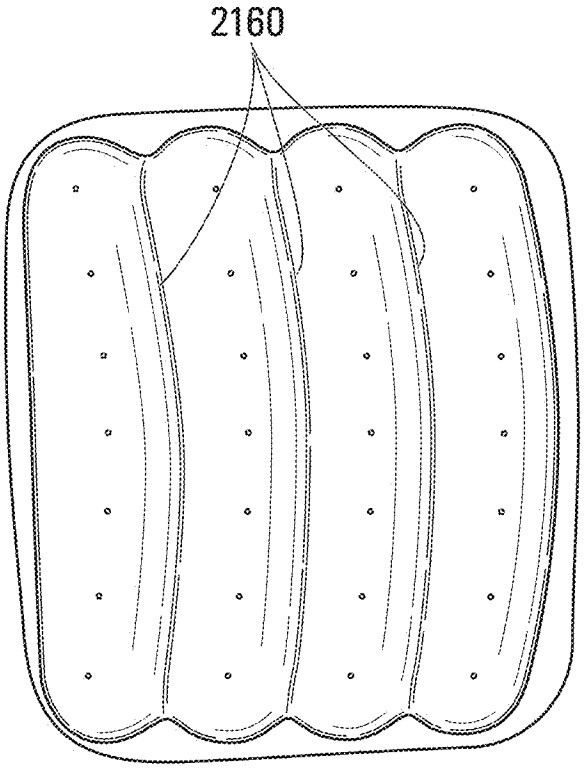
FIGS. 12A and 12B are views of the alternative embodiment depicted in FIGS. 11A and 11B.
Figure 12A:
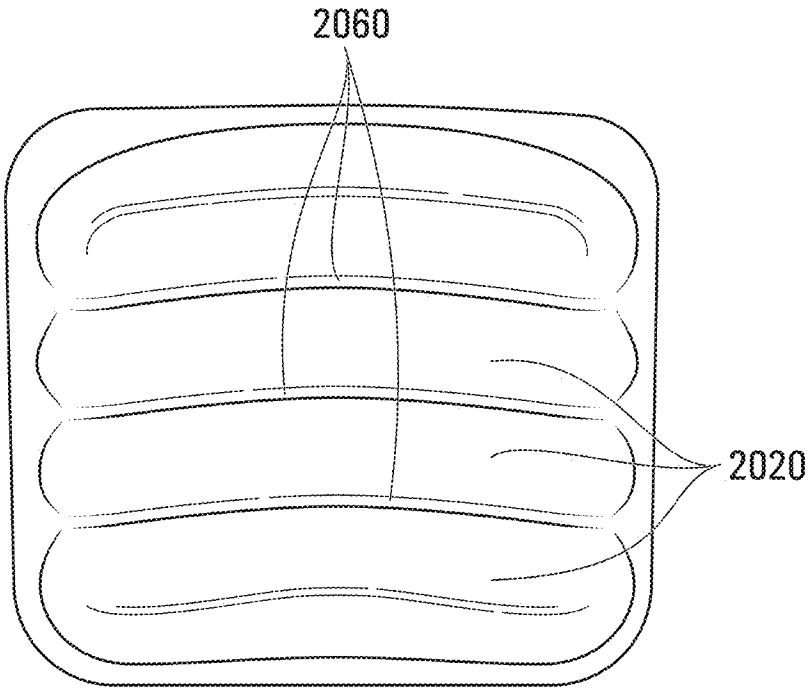

FIGS. 11A and 11B are perspective and side views of a tray 2000 which is adapted to received curved sausages. The cells 2020 are configured to receive the curved sausages and the ribs 2060 provide similar structural and functional benefits as ribs 106 and 1060 described above, with additional curvature, in that the sausages may be guided into cells 2020 and be helped in maintaining their shape by cells 2020 having a shape substantially similar to a portion of the sausage being received. Although not shown, embodiments are also contemplated for cells for sausages with similar dimensions to tray 2000 but without the curvature. Tray 2000 is also stackable, as the rib grooves 2160 are complementary in shape to ribs 2060.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A packaging system comprising:

at least one fresh food article having a diameter;

a first tray comprising:

a plurality of cells, each cell including a seat and one or more ribs defining the shape of said respective cell, said seat and said one or more ribs configured to receive a respective one of said at least one said fresh food article;

an outer top surface having a height relative to the seat of each cell that is less than said diameter of said at least one fresh food article;

a plurality of base support columns protruding vertically upward at intersections of the one or more ribs, wherein a height of said plurality of base support columns is less than said diameter of said at least one fresh food article;

a sealing pouch adapted to be vacuum sealed around said tray and said at least one fresh food article, said sealing pouch configured to temporarily deform at least a portion of said at least one fresh food article from an original shape into a smooth upper surface.

2. The packaging system of claim 1, further comprising a second tray stacked on the smooth upper surface of the first tray.

3. The packaging system of claim 1, wherein the at least one fresh food article returns to the original shape of the at least one fresh food article upon removing said sealing pouch.

4. The packaging system of claim 1, wherein the at least one fresh food article returns to at least 87.5% of the original shape of the at least one fresh food article after removing said sealing pouch.

5. The packaging system of claim 1, wherein the plurality of cells includes 12 cells.

6. The packaging system of claim 1, wherein the plurality of cells includes 4 cells.

7. The packaging system of claim 1, wherein the plurality of cells includes 8 cells.

8. The packaging system of claim 1, wherein said at least one fresh food article is at least one fresh meat article.

* * * * *